US006061938A

United States Patent [19]

Young

[11] Patent Number: 6,061,938

[45] Date of Patent: May 16, 2000

[54] CHANGEABLE IMAGE DISPLAY DEVICE

[76] Inventor: Steven R. Young, 7667 Chalkstone Dr., Dallas, Tex. 75248

[21] Appl. No.: 09/089,571

[22] Filed: Jun. 3, 1998

[51] Int. Cl.[7] ..... G09F 19/00

[52] U.S. Cl. ..... 40/490; 40/124.09; 40/445; 40/491; 116/321

[58] Field of Search ..... 40/124.09, 445, 40/488, 490, 491; 116/321, 324

[56] References Cited

U.S. PATENT DOCUMENTS

| | | | |
|---|---|---|---|
| 418,135 | 12/1889 | Kaufmann . | |
| 946,407 | 1/1910 | Spiegel . | |
| 1,658,968 | 2/1928 | Carroll | 40/488 |
| 2,359,195 | 9/1944 | Berliner et al. | 35/66 |
| 2,367,967 | 1/1945 | Schwartz | 40/65 |
| 2,611,201 | 9/1952 | Bellis | 40/65 |
| 2,988,845 | 6/1961 | MacDougall et al. | 40/445 |
| 3,848,348 | 11/1974 | Hawley | 40/64 R |
| 4,233,768 | 11/1980 | Bromberg | 40/491 X |
| 4,697,364 | 10/1987 | Dean | 40/445 |

FOREIGN PATENT DOCUMENTS

| | | | |
|---|---|---|---|
| 675561 | 12/1963 | Canada | 40/124.5 |
| 2291041 | 11/1976 | France . | |

*Primary Examiner*—Brian K. Green
*Assistant Examiner*—Andrea Chop
*Attorney, Agent, or Firm*—Jones, Day, Reavis & Pogue

[57] ABSTRACT

A changeable image display device that has a front panel and a back panel forming an envelope open at one end. The front panel has first and second spaced windows and the back panel has a first image thereon in alignment with the first window of the front panel. A stationary transparency is fixed between the front and back panels and has second and third visual images thereon. A slidable V-shaped insert in the device moves between recessed and retracted positions and has first and second legs straddling the stationary transparency. A third window in the first leg of the V-shaped insert exposes the second visual image in the recessed position and exposes the third visual image in the retracted position. The second leg of the V-shaped insert covers the first visual image in the recessed position and exposes the first visual image in combination with the second visual image in the retracted position.

10 Claims, 2 Drawing Sheets

CHANGEABLE IMAGE DISPLAY DEVICE

BACKGROUND OF THE INVENTION

1. Field of the Invention

The present invention relates in general to display packages and more particularly, but not by way of limitation, to an improved display device that has first and second windows therein for displaying visual images that are on a transparency divider on the inside of the device. A slidable insert straddles the transparency divider and is movable between a first recessed position within the device and a second retracted position extending at least partially out of the device. By moving the slidable insert from its recessed position to its retracted position, the picture in the first window changes and appears to move to the second window. The display device can be used for greeting cards, trading cards, and novelty cards of all types.

2. Description of Related Art Including Information Disclosed Under 37 CFR 1.97 and 1.98

It is well known in the art to use transparency display devices having a window for viewing a dividable insert contained within an envelope and that has an image thereon that changes in appearance as the insert is slidably moved within the envelope through a top slot. See U.S. Pat. No. 4,697,364. The dividable insert includes a front transparent portion and a rear background portion separated by a divider fixed within the envelope in the inserted position and which front and rear portions are combined upon removal of the insert from the envelope to change the image seen by the observer. Further, as shown in U.S. Pat. No. 2,611,201, the reverse is also true. In that patent, the insert is a divider that separates two transparencies. As the insert is removed, the transparencies with their images remain fixed and combine and, when combined, they change the image seen by the observer.

It would be advantageous to use a plurality of windows in the display device where images change within the windows as the insert is moved from a recessed position to a retracted position.

SUMMARY OF THE INVENTION

The present image display device has a planar frame with a front panel and a back panel. The front panel has first and second spaced window openings therein and a first visual image is placed on the back panel in alignment with the first window opening in the front panel. The transparency divider between the front panel and the back panel has second and third visual images thereon in alignment with the first and second windows, respectively. A slidable insert is V-shaped with one leg of the V between the front panel and the transparency divider and the other leg of the V being located between the transparency divider and the back panel. Thus the V-shaped insert has an outer apex end and an inner end. The first and second legs are joined at the apex end and straddle the transparency divider with the second leg covering the frame back panel in the recessed position. The V-shaped insert also exposes at least the first visual image on the back panel in combination with the second visual image on the transparency in the retracted position. A third window opening is formed in a first portion of the first leg of the V-shaped insert to expose the second visual image on the transparency divider in the recessed position and to expose the third visual image on the transparency divider in the retracted position.

If desired, indicia may be placed on the front leg and exposed in the second window when the slidable insert is recessed and exposed externally of the frame when the V-shaped insert is in the retracted position.

The first visual image may be in color and the second visual image may be in black and white so that, when the images are combined, a strikingly different visual impression is given.

In addition, the second and third visual images on the transparency may be identical so that, when the slidable insert is moved from the recessed position to the retracted position, the second image appears to move from the first window to the second window.

Appropriate stop devices may be provided to limit movement of the slidable insert from its recessed position to its retracted position.

By providing a border on the inner end of the first leg of the V-shaped insert that covers the inner end of the second leg of the V-shaped insert, movement of the second leg is obscured so as to increase curiosity about how the first and second visual images are combined.

Thus, it is an object of the present invention to provide a changeable image display device having a back panel with a first image thereon, a first panel having first and second spaced windows therein, a stationary transparency between the first and back panels that has second and third visual images thereon, and a V-shaped slidable insert movable between recessed and retracted positions and having first and second legs straddling the stationary transparency such that a third window in the first leg of the V-shaped insert exposes the second visual image on the stationary transparency in the recessed position and exposes the third visual image on the stationary transparency in the retracted position and in which the second leg of the V-shaped insert covers the first visual image on the back panel in the second position and exposes the first visual image on the back panel in combination with the second visual image on the transparency in the retracted position.

It is also an object of the present invention to provide indicia on one leg of the V-shaped insert that is exposed in a window opening in the frame when the slidable insert is recessed and exposed externally of the frame when the V-shaped insert is in the retracted position.

It is still another object of the present invention to provide a changeable image display device wherein first and second images to be combined are in color and in black and white, respectively.

It is yet another object of the present invention to provide a changeable image display device having two images on a stationary transparency that are identical so that when a slidable insert that straddles the stationary transparency is moved from the recessed position to the retracted position, a window in the slidable insert exposes a visual image in the recessed position and an identical image in the retracted position.

Thus, the invention relates to a changeable image display device comprising a front panel having first and second spaced windows therein, a back panel having a first visual image therein in alignment with the first window of the front panel, a stationary transparency positioned between said front and back panels and having second and third visual images thereon, a slidable V-shaped insert in the display device movable between recessed and retracted positions and having first and second legs straddling the stationary transparency, a third window in the first leg of the V-shaped insert for exposing the second visual image in the recessed position and exposing the third visual image in the retracted position, and the second leg of the V-shaped insert covering the first visual image in the second position and exposing the first visual image in combination with the second visual image in the retracted position.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
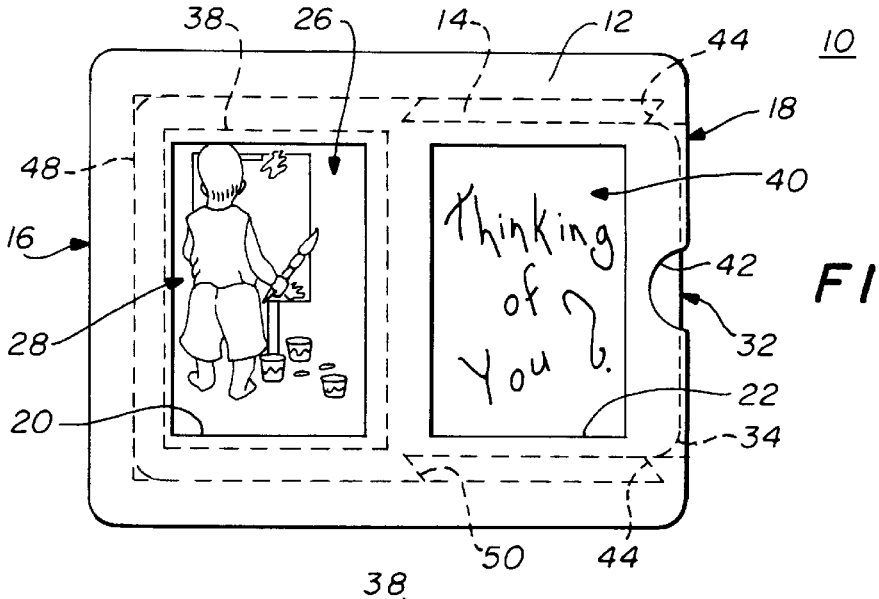
FIG. 1 is a plan view of the novel display device illustrating one visual image on the transparency being displayed in a first front panel window and indicia relating to the display shown in the second front panel window.

FIG. 1 is a plan view of the novel image display device with the slidable insert in its recessed position. The display device comprises a planar frame 10 having a front panel 12, a back panel 14, a closed end 16, and an open end 18.

Figure 2:
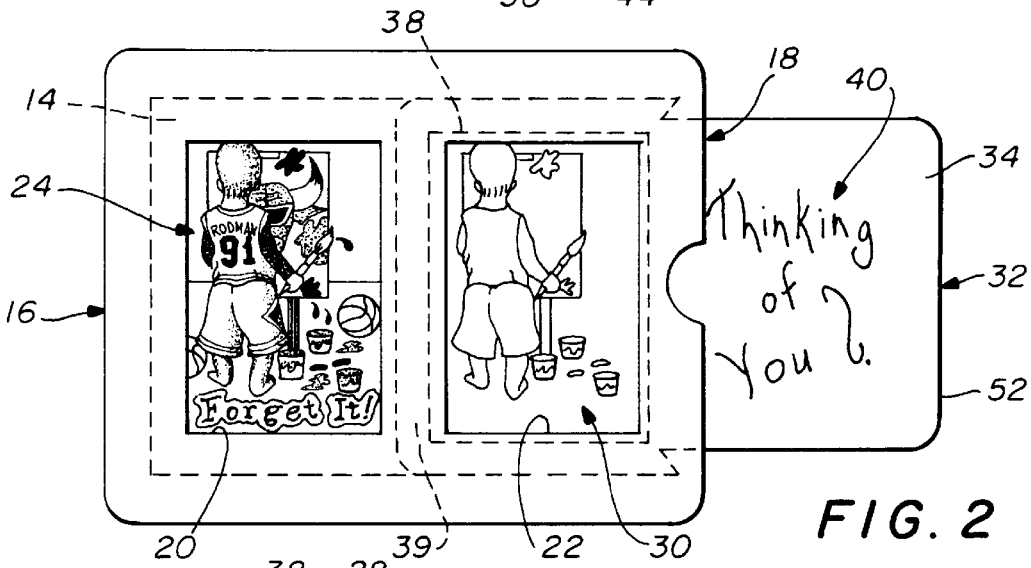
FIG. 2 is a plan view of the novel display device with the movable insert in the retracted position illustrating one visual image on the transparency combined with a visual image on the back panel of the display device to provide a discernably different visual image to the viewer and a third visual image in the second front panel window with the indicia now being external to the display device.

First and second spaced window openings 20 and 22 are formed in the front panel 12. A first visual image 24 (see FIGS. 2, 3, and 4) on the back panel 14 is in alignment with the first window opening 20. This can be seen most clearly in FIG. 4. A transparency divider 26 is attached in any well-known manner inside the frame 10 at the closed end 16 so that it is fixed or stationary. A second visual image 28 is formed on the transparency divider 26 in alignment with and complementing the first image 24. Again, this can be seen clearly in FIG. 4. A third visual image 30, seen best in FIG. 2, is formed on the transparency 26 in alignment with the second spaced window 22. The visual images can, of course, be any type of image desired such as sports figures, places, objects, space scenes, cartoon characters, and other images.

A slidable V-shaped insert 32 in the frame 10 is movable between a recessed and an extracted position and has an outer apex end 52 (see FIG. 2 and FIG. 4) and an inner end 48. The V-shaped insert 32 has a first and second legs 34 and 36, best seen in FIG. 4, joined at the apex 52. The first and second legs 34 and 36 straddle the transparency divider 26 with the second leg 34 covering the frame back panel 14 in the recessed position and exposing at least the first visual image 24 on the back panel 14 in combination with the second visual image 28 on the transparency when in the retracted position. A third window opening 38 is formed in the first leg 36 of the V-shaped insert 32 in alignment with the first window opening 20 in the front panel 12 to expose the second visual image 28 on the transparency divider 26 in the recessed position and exposes the third visual image 30 on the transparency divider 26 in the retracted position.

Thus as can be seen in FIG. 1, the second visual image 28 on the transparency divider 26 is shown in the first window 20 while indicia 40 is exposed in the second window 22 when the slidable insert 32 is in the recessed position.

When the slidable insert 32 is moved to its retracted position, as shown in FIG. 2, the second leg 36 of the V-shaped insert uncovers the first image 24 on the back panel 14 and it is combined with the second image 28 on the transparency 26 to form a new image as can be seen in FIG. 2. The first image 24 on the back panel 14 may be in color, for instance, and, when it is combined with the black and white image 28 on the transparency 26, it gives a unique appearance. In addition, as can be seen, different elements, wording and/or indicia may be shown on the first visual image 24, which changes the appearance of the black and white image 28.

Also as can be seen in FIG. 2, the indicia 40 is moved external of the display device when the movable insert 32 is moved to its retracted position. At the same time, the window 38 in the front leg 34 of the movable insert 32 now exposes the third visual image 30 on the transparency display as shown. The two images on the transparency display, 28 and 30, may be identical so that moving the movable insert 32 to its retracted position to expose the combination of first visual image 24 and transparency visual image 28 in a combined relationship also causes third visual image 30 on the transparency display to suddenly appear to have been moved from its first position as shown in FIG. 1 to the second position as shown in FIG. 2. As stated, the first image 24 may be in color and the second image 28 may be black and white.

Figure 4:
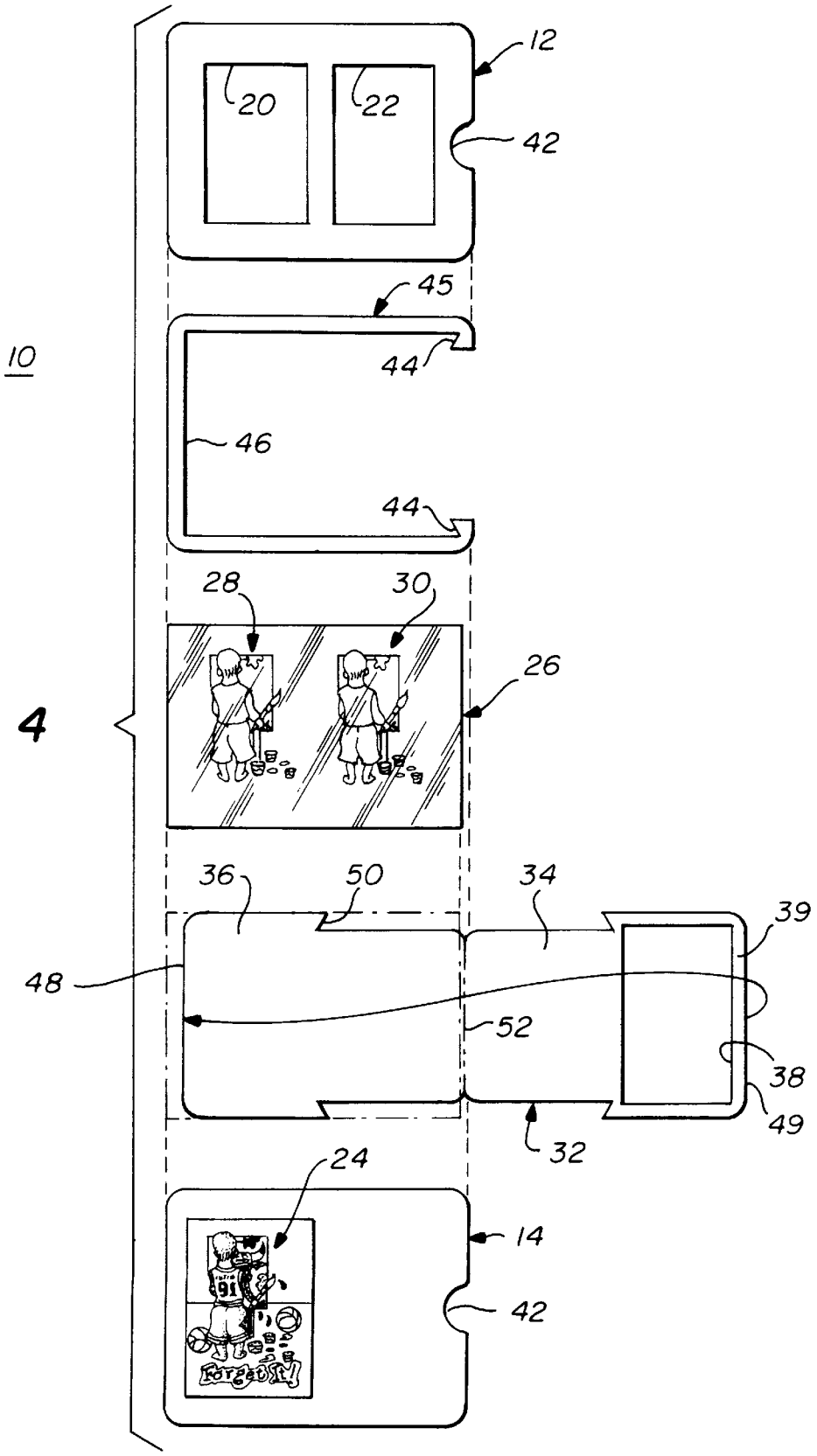
FIG. 4 is an exploded view of the elements of the novel display device as shown in FIGS. 1, 2, and 3.

As can be seen in FIG. 4, at least one spacer 45 is placed between the front panel 12 and the back panel 14 of the frame 10. Spacer 45 has a base portion 46 and shoulders 44 that mate with a shoulder-engaging extension 50 on the V-shaped insert 32 as shown in FIG. 4 for limiting movement of the V-shaped insert 32 towards the retracted position.

Figure 3:
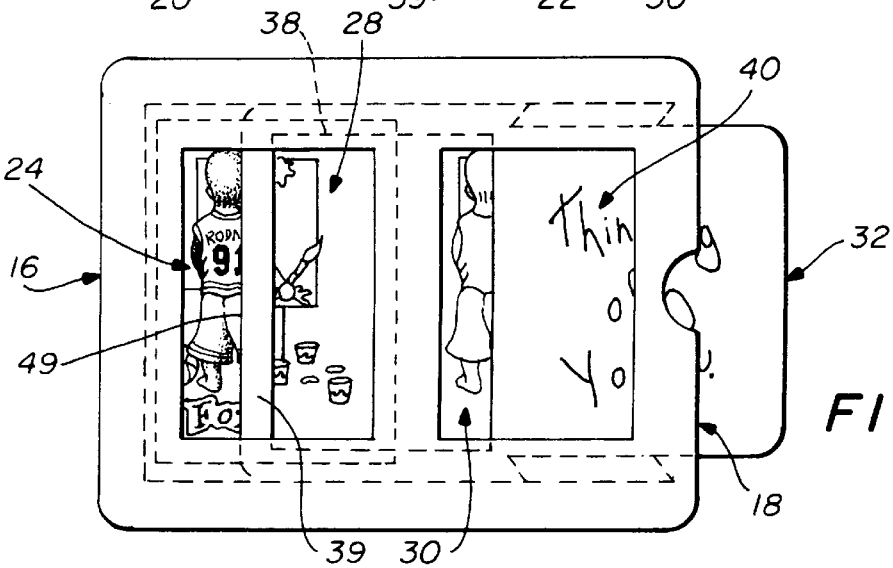
FIG. 3 is a plan view of the novel display device illustrating the movable insert partially removed from the recessed position toward the retracted position to illustrate how the images in the first and second front panel windows change when the slidable insert is moved from its recessed to its retracted position.

As can best be seen in FIGS. 3 and 4, a border 39 is formed on the inner end 49 of the first leg 34 of the V-shaped insert 32 that covers the inner end 48 of the second leg 36 of the V-shaped insert 32. Border 39 obscures movement of the second leg 36 as shown in FIG. 3 so as to increase curiosity about how the first and second visual images 24 and 28 are combined. In FIG. 3, the V-shaped insert 32 is shown at a position between the fully recessed position and the fully retracted position.

Thus, when the slidable insert 32 has moved from its recessed position shown in FIG. 1 to its retracted position shown in FIG. 2, the second image 28 on the transparency is modified by the first image 24 on the back panel 14 to form a fourth image 40 shown in FIG. 2 when the slidable insert 32 is retracted.

It will be appreciated that the display device could be a trading card, a greeting card, or any other type of display device illustrating changeable visual images thereon.

Thus, there has been disclosed a changeable image display device that has a front panel having first and second spaced windows therein, a back panel having a first visual image thereon in alignment with the first window of the front panel, a stationary transparency between the front and back panels that has second and third visual images thereon, a slidable V-shaped insert in the display device movable between recessed and retracted positions and having first and second legs straddling the stationary transparency. A third window in the first leg of the V-shaped insert exposes the second visual image in the recessed position and exposes the third visual image in the retracted position. The second leg of the V-shaped insert covers the first visual image on the back panel in the recessed position and exposes the first visual image on the back panel in combination with the second visual image on the transparency in the retracted position.

The corresponding structures, materials, acts, and equivalents of all means or step plus function elements in the claims below are intended to include any structure, material, or act for performing the function in combination with other claimed elements as specifically claimed.

I claim:

1. A changeable image display device comprising:

a planar frame having a front panel, a back panel, a closed end, and an open end;

first and second spaced window openings in said front panel;

a first visual image on said back panel in alignment with said first window opening;

a transparency divider attached inside the frame at the closed end;

a second visual image on the transparency divider in alignment with and complementing the first image;

a third visual image on the transparency divider in alignment with the second window opening;

a slidable V-shaped insert in said frame movable between recessed and retracted positions and having an outer apex end and an inner end;

said V-shaped insert having first and second legs joined at said apex end, the first and second legs straddling the transparency divider with the second leg covering the frame back panel in the recessed position and exposing said first visual image on the back panel in combination with the second visual image on the transparency divider when in the retracted position; and a third window opening in said first leg of said V-shaped insert in alignment with said first window opening in said front panel to expose said second visual image on said transparency divider in the recessed position and to expose the third visual image on said transparency divider in the retracted position.

2. The changeable image display device of claim 1 further comprising:

indicia on said first leg of said V-shaped insert exposed in said second window when said slidable insert is in the recessed position and exposed externally of said frame when the V-shaped insert is in the retracted position, said indicia being related to at least one of said first, second, and third visual images.

3. The changeable image display device of claim 1 wherein said first visual image is in color and said second visual image is black and white.

4. The changeable image display device of claim 1 wherein said second and third visual images are identical so that when said slidable insert is moved from said recessed position to said retracted position, said second image appears to move from said first window opening to said second window opening.

5. The changeable image display device of claim 1 further including:

a spacer between said front panel and said back panel of said frame;

a shoulder on said spacer; and a shoulder-engaging extension on said V-shaped insert for limiting movement of said V-shaped insert towards the retracted position.

6. The changeable image display device of claim 1 wherein said second image is modified by said first image to form a fourth image when said slidable insert is in the retracted position.

7. The changeable image display device of claim 6 further including a border on the inner end of said first leg of said V-shaped insert that covers the inner end of said second leg of said V-shaped insert to obscure movement of said second leg so as to increase curiosity about how the first and second visual images are combined.

8. The changeable image display device of claim 1 wherein said display device is a trading card.

9. The changeable image display device of claim 1 wherein said display device is a greeting card.

10. A changeable image display device comprising:

a front panel having first and second spaced windows therein;

a back panel having a first visual image therein in alignment with said first window of said front panel;

a stationary transparency having second and third visual images thereon;

a slidable V-shaped insert in said display device movable between recessed and retracted positions and having first and second legs straddling the stationary transparency;

a third window in the first leg of the V-shaped insert for exposing the second visual image in the recessed position and exposing the third visual image in the retracted position; and the second leg of said V-shaped insert covering said first visual image in the recessed position and exposing said first visual image in combination with said second visual image in said retracted position.

* * * * *